United States Patent [19]

Cowan

[11] Patent Number: 4,817,494

[45] Date of Patent: Apr. 4, 1989

[54] MAGNETIC RECONNECTION LAUNCHER

[75] Inventor: Maynard Cowan, Albuquerque, N. Mex.

[73] Assignee: The United States of America as represented by the United States Department of Energy, Washington, D.C.

[21] Appl. No.: 34,354

[22] Filed: Apr. 6, 1987

[51] Int. Cl.[4] ..... F41F 1/02

[52] U.S. Cl. ..... 89/8; 124/3; 318/38

[58] Field of Search ..... 89/8; 104/282, 284; 124/3; 318/38

[56] References Cited

U.S. PATENT DOCUMENTS

| | | | |
|---|---|---|---|
| 1,020,942 | 3/1912 | Bachelet | 104/282 |
| 1,370,200 | 3/1921 | Fauchon-Villeplee | 89/8 |
| 1,421,435 | 7/1922 | Fauchon-Villeplee | 124/3 |
| 1,422,427 | 7/1922 | Fauchon-Villeplee | 124/3 |
| 2,112,264 | 3/1938 | Bowles et al. | 124/3 |
| 2,235,201 | 3/1941 | Cole | 89/8 |
| 3,273,553 | 9/1966 | Doyle | 124/3 |
| 3,697,908 | 10/1972 | Highsmith | 335/209 |
| 3,857,050 | 12/1974 | Harris et al. | 310/13 |
| 3,884,154 | 5/1975 | Marten | 104/148 |
| 4,132,910 | 1/1979 | Kiss et al. | 310/12 |
| 4,217,507 | 8/1980 | Jaffe et al. | 310/12 |
| 4,346,318 | 8/1982 | Shtrikman | 310/12 |
| 4,347,463 | 8/1982 | Kemeny et al. | 318/135 |
| 4,358,691 | 11/1982 | Naylor | 310/12 |
| 4,432,333 | 2/1984 | Kurherr | 124/3 |
| 4,433,608 | 2/1984 | Deis et al. | 89/8 |
| 4,449,441 | 5/1984 | McAllister | 89/8 |
| 4,485,720 | 12/1984 | Kemeny | 89/8 |

FOREIGN PATENT DOCUMENTS

| | | | |
|---|---|---|---|
| 448496 | 6/1936 | United Kingdom | 89/8 |

OTHER PUBLICATIONS

Materials Selector, Mid-Oct. 1965, p. 147.

Driga et al, Coaxial Electromagnetic Launchers, '86 Proceedings of Electromagnetic launch Technology, pp. 51–56.

Grob, Basic Electronics, 1984, pp. 288–290.

From *IEEE Transactions On Magnetics,* vol. MAG-18, No. 1, 01/82: (1) Fair, Harry Jr., "Electromagnetic Propulsion: A New Initiative", pp. 4–6; (2) Mongeau & Williams, Arc-Commutated Launcher, pp. 42–45; (3) Burgess, Cnare, Oberkampf, Beard & Cowan, The Electromagnetic $\theta$ Gun and Tubular Projectiles, pp. 46–59; (4) Snow, Dunbar, kubby, O'Neill, Mass Driver Two: A Status Report pp. 127–134.

Cowan, Cnare, Duggin, Kaye, and Tucker, "The Reconnection Gun", 3rd Symposium on Electromagnetic Launch Technology, Apr. 21–24, 1986, Published in *IEEE Transactions or Magnetics,* vol. MAG-22, No. 6 (Nov., 1986), pp. 1429–1434.

Cowan, "Proposal For the Reconnection Gun", proposal No. 1260326GA, Dept. 1220, Sandia National Laboratories, 4/86.

From *IEEE Transactions On Magnetics,* vol. MAG-20, No. 2, 3/84: (1) Kolm & Mongeau, "Basic Principles of Coaxial Launch Technology", pp. 227–230 (2) Burgess & Cowan, Multistage Induction Mass Accelerator pp. 235–238 (3) McKinney and Mongeau, Multiple Stage Pulsed Induction Acceleration, pp. 239–242.

*Primary Examiner*—Stephen C. Bentley

*Attorney, Agent, or Firm*—George H. Libman; James H. Chafin; Judson R. Hightower

[57] ABSTRACT

An electromagnetic launcher includes a plurality of electrical stages which are energized sequentially in synchrony with the passage of a projectile. Each stage of the launcher includes two or more coils which are arranged coaxially on either closed-loop or straight lines to form gaps between their ends. The projectile has an electrically conductive gap-portion that passes through all the gaps of all the stages in a direction transverse to the axes of the coils. The coils receive an electric current, store magnetic energy, and convert a significant portion of the stored magnetic energy into kinetic energy of the projectile by magnetic reconnection as the gap portion of the projectile moves through the gap. The magnetic polarity of the opposing coils is in the same direction, e.g. N-S-N-S. A gap portion of the projectile may be made from aluminum and is propelled by the reconnection of magnetic flux stored in the coils which causes accelerating forces to act upon the projectile at both the rear vertical surface of the projectile and at the horizontal surfaces of the projectile near its rear. The gap portion of the projectile may be flat, rectangular and longer than the length of the opposing coils and fit loosely within the gap between the opposing coils.

20 Claims, 4 Drawing Sheets

MAGNETIC RECONNECTION LAUNCHER

FIELD OF THE INVENTION

The present invention relates to the field of guns or other projectile launchers, and more particularly to guns for launching projectiles using magnetic energy exerted by electromagnets. The United States Government has rights in this invention pursuant to Contract No. DE-AC04-76DP00789 between the United States Department of Energy and AT&T Technologies, Inc.

BACKGROUND OF THE INVENTION

In the art of guns in which projectiles are projected by non-chemical means, the use of magnetic energy to launch projectiles is known. Such magnetic energy may be generated by the use of electromagnets or permanent magnets. Generally, in electromagnet guns, electromagnet coils are arranged with respect to a barrel in an array so that the axes of the coils are collinear or parallel to the axis of the barrel and thereby parallel to the direction of the projectile motion down the barrel. Two types of such prior art electromagnetic guns are known as plasma-armature railguns, or simply railguns, and coaxial induction guns.

Railguns are limited in their performance by barrel effects such as wall ablations. It would be desirable to provide an electromagnetic gun that is not plagued with deleterious wall ablation effects.

Coaxial induction launchers present problems to effective performance because their major magnetic forces are radial and non-accelerating rather than axial and in-line with the velocity of the projectile. Also, there is a substantial problem of ohmic heating of the armature with coaxial induction launchers. It would be desirable to provide an electromagnetic gun with minimum radial magnetic forces and maximum axial magnetic forces. Also, it would be desirable to provide an electromagnetic gun with minimal effects due to ohmic heating.

Railguns and coaxial induction guns are limited to the volume of the gun bore with regard to the volume of magnetic energy used for accelerating the projectile down the barrel. It would be desirable to provide an electromagnetic gun which can use a larger volume of accelerating magnetic energy.

There are a number of other electromagnetic guns in the prior art. In such guns, an arrangement of electromagnet coils is provided along the gun barrel with coil axes transverse to the direction of projectile motion. In one such gun, the transversely arrayed coils are arranged in opposing N-N or S-S orientation and are used to bring about spin in cylindrical projectiles in the barrel. Opposing magnetic polarities in electromagnets inherently consume more electric energy than complementary N-S and S-N arrangements. It would be desirable to provide an electromagnetic gun which employs complementary N-S or S-N electromagnets.

In another prior art electromagnetic gun which employs coils arranged transverse to the direction of projectile motion along the barrel, a pair of flat rails have a steady direct current flowing therethrough which is used to interact with the magnetic field across the coils to provide a net accelerating force on a flat projectile. It would be desirable to provide an electromagnetic gun which does not require additional rails to bring about acceleration of the projectile.

In general, with the prior art electromagnetic guns in which transversely arranged coils are used, the transversely arranged coils do not and cannot bring about an increase in projectile velocity through the barrel. The coils are actuated with current prior to arrival of the projectile and are maintained in an actuated state while the projectile passes the coils. In fact, permanent magnets could replace the electromagnets and provide a constant magnetic flux. As the projectile is propelled down the barrel, it experiences both deceleration and acceleration as the projectile enters and exits the gap between opposing coils. Thus, even though there are induced currents generated in the projectile as it moves down the barrel, the net acceleration effect due to those induced currents is zero because of the cancelling of deceleration and acceleration effects. It would be desirable if an electromagnetic gun did not have the inherently cancelling deceleration and acceleration effects upon a projectile having induced currents that moves down the barrel of the gun.

Another feature of prior art electromagnetic guns is the use of projectiles made from a magnetic material. Projectiles made from a magnetic material limit the magnetic pressure that can be applied. Therefore, when a magnetic projectile is used, high acceleration cannot be achieved. It would be desirable to provide an electromagnetic gun which employs a nonmagnetic projectile.

SUMMARY OF THE INVENTION

Accordingly, it is a primary object of the present invention to provide an electromagnetic gun or launcher which delivers much more energy per unit length of the gun to a projectile than prior art electromagnetic guns or launchers.

Another object of the invention is to provide an electromagnetic gun or launcher which can use a larger volume of accelerating magnetic energy than the volume limited by the gun bore.

Another object is to provide an electromagnetic gun or launcher which employs complementary N-S or S-N electromagnets.

Still another object of the invention is to provide an electromagnetic gun which does not require additional conductive rails to bring about acceleration of the projectile.

An additional object of the invention is to provide an electromagnetic gun or launcher which does not have inherently cancelling deceleration and acceleration effects upon a projectile having induced currents that moves down the barrel of the gun.

Yet another object of the present invention is to provide an electromagnetic gun which employs a nonmagnetic projectile.

Still another object of the invention is to provide an electromagnetic gun or launcher that is not plagued with deleterious wall ablation effects.

Another object of the invention is to provide an electromagnetic gun or launcher having minimum non-accelerating magnetic forces and maximum accelerating magnetic forces.

Yet another object of the invention is to provide an electromagnetic gun or launcher having reduced ohmic heating.

Still another object of the invention is to provide an improved launcher for a self-propelled projectile such as a rocket or an airplane.

Additional objects, advantaages, and novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved electromagnetic gun or launcher is provided wherein opposed electromagnetic coils are arranged transverse to the direction of motion of a projectile (or portion thereof) down a nonmaterial flyway defined by the magnetic force fields provided by the coils which confine the projectile (or portion thereof) to the flyway through the gun. The magnetic polarity of the opposing coils is a complementary N-S-N-S or S-N-S-N whereby the coils align the magnetic flux in the same direction in opposing coils. The opposing coils are separated by a gap which coincides with a part of the flyway for the projectile and in which a gap portion of the projectile is confined. Electric current is supplied to opposing coils so that substantially equal current circulates in the same direction in each coil. Induced eddy currents circulate in the opposite direction in the gap portion of the projectile with a substantially unrestricted distribution of eddy current densities. The portion of the projectile in the gap between the opposing coils is preferably flat and made from a rectangular plate of highly conductive material. The current applied to the coils is synchronized with respect to the position of the gap portion of the projectile in relation to the coils. No current and therefore no magnetic field is present in the coils when the gap portion of the projectile first enters the gap between the coils. Current is applied quickly to the electromagnets only when the gap portion of the projectile substantially occupies the gap between the opposing coils.

Preferably, the gap portion of the projectile is a flat plate which is longer than the diameter or width of the coils. The length of the flat plate gap portion of the projectile and the rise time of the current are varied so that peak current is reached during this period when the gap portion of the projectile fully occupies the gap between the coils. At this time, the magnetic flux of the coil above the gap portion of the projectile is substantially isolated from the magnetic flux of the coil below the gap portion of the projectile, and the electric energy applied to the isolated electromagnet coils is substantially stored as potential energy in the form of magnetic energy in the isolated magnets. As the gap portion of the projectile exits the gap between the coils, the isolation between the upper and lower coils is removed, and the magnetic lines of flux between the coils reconnect. As the magnetic lines of flux between the previously isolated magnets reconnect, the stored magnetic energy is substantially converted to kinetic energy of the projectile because the trailing edge of the gap portion of the projectile is subjected to powerful accelerating forces by the reconnecting magnetic flux. Thereby, acceleration of the projectile is achieved without an equal amount of deceleration.

A plurality of transverse coil stages are used with the invention. A separate power supply may be provided for each stage, and the position and velocity of the projectile itself is detected, measured and processed by some means to switch a stage on at the appropriate time. The direction of magnetic flux through the coils will not be the same for all of the plurality of stages in the launcher. In general, the flux will have the same direction for a number of contiguous stages, and then it will be reversed for the next number of contiguous stages and so on. This procedure will allow control of the amount of magnetic diffusion into the projectile to keep the propelling force strong and yet limit the amount of ohmic heating in the projectile. The number of contiguous stages that have the same flux direction will vary along the launcher and will depend on the speed and electrical resistivity of the projectile.

The electrically conductive gap portion of the projectile is substantially inductively coupled to the magnetic flux exerted by the coils because it is a flat plate that fits loosely between the opposing coils at each stage. Because the gap portion of the projectile is made from electrically conductive material, a very great magnetic pressure can be used.

Although the flyway through which the gap portion of the projectile moves may be a nonmaterial flyway defined by confining magnetic fields, alternatively, material guide rails may be employed to guide the gap portion of the projectile during its transverse motion through the gap between the opposing coils. The guide rails may be a pair of opposed and spaced apart guides each of which has a complementary fit with the sides of the projectile.

Preferably, the coils of the invention are constructed of high-strength beryllium copper and steel and support a high linear current density and thereby a high magnetic pressure.

For equivalent projectiles, the ratio of the kinetic energy of the projectile per length of the launcher, and thereby the acceleration of the projectile, is approximately ten times greater with the electromagnetic gun of the invention than with prior art railgun type electromagnetic guns. The acceleration of the projectile with the invention is even greater than ten times greater than prior art coaxial induction type guns. Because acceleration of the projectile is higher with the invention, a shorter launcher can be used with an electromagnetic gun of the present invention. In many areas of application, launcher length or barrel length is a critical design parameter.

Other advantages that result from using the electromagnetic gun or launcher of the invention include the fact that no barrel is used in which there is contact between the barrel and the projectile within the barrel. With the invention, the gap portion of the projectile advances down the launcher within a flyway defined by nonmaterial magnetic fields. Furthermore, the gap portion of the projectile is confined to the flyway by the magnetic fields thereby eliminating the need for a barrel fabricated from some kind of material. Optionally, a pair of opposing guide rails may be used to guide a projectile or a gap portion of the projectile through the gun. Another advantage of employing the principles of the invention is that, with the invention, there is no drop in acceleraton with increase in projectile mass.

Still other objects of the present invention will become readily apparent to those skilled in this art from the following description, wherein there is shown and described a preferred embodiment of this invention. Simply by way of illustration, the invention will be set forth in part in the description that follows and in part will become apparent to those skilled in the art upon examination of the following or may be learned with the practice of the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF A PREFERRED EMBODIMENT OF THE INVENTION

Figure 1:
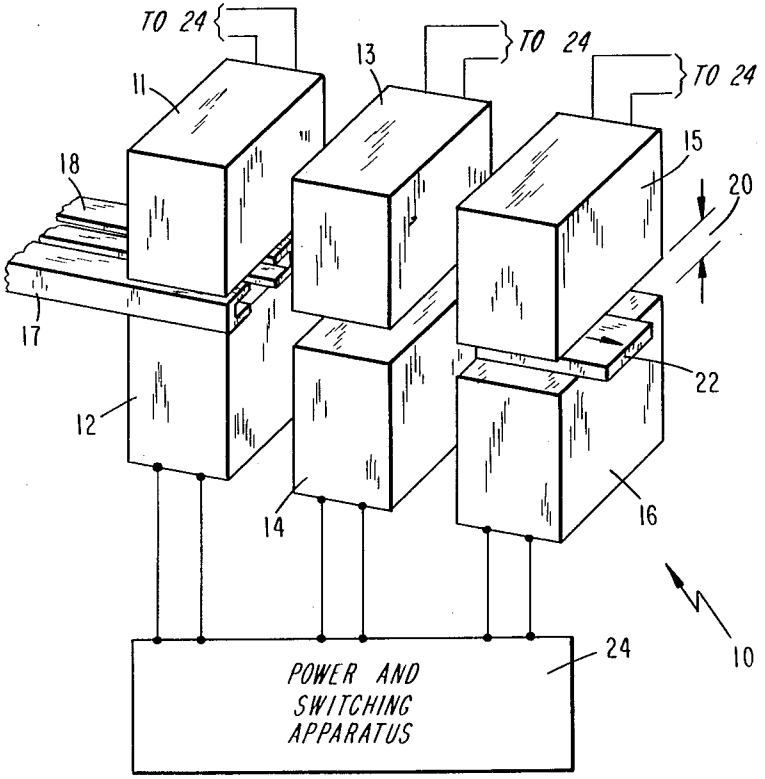
FIG. 1 shows a perspective view of an idealized magnetic reconnection launcher with a portion of the launcher showing an optional guideway.

With reference to the drawings, and more particularly to FIG. 1, there is disclosed a preferred embodiment of the magnetic reconnection launcher 10 of the present invention. Therein, three pairs of rectangular, coaxial, and vertically opposing coils 11,12; 13,14; and 15,16 are spaced apart by a gap 20. A pair of optional horizontal opposing guide rails 17 and 18 are shown spaced apart between the opposing coils in the gap 20. A flat plate projectile 22 in the gap between coil pair 15,16 has a direction of movement from left to right through the launcher as shown by the arrow. The projectile passes through the gap in a direction which is transverse to the axes of the coils. Each coil is connected to an electric power and switching apparatus 24 which supplies electric power to the coils to cause the coils to generate an electromagnetic flux to form electromagnets. The power and switching apparatus 24 also controls the timing of power applied to the coils. A power supply of a type shown in FIG. 8, to be described hereinbelow, automatically produces the required timed power switching for the electromagnetic launcher of the invention. Each pair of opposed coils can have its own power supply; alternatively one power supply can be used for all of the pairs of coils.

Figure 6:
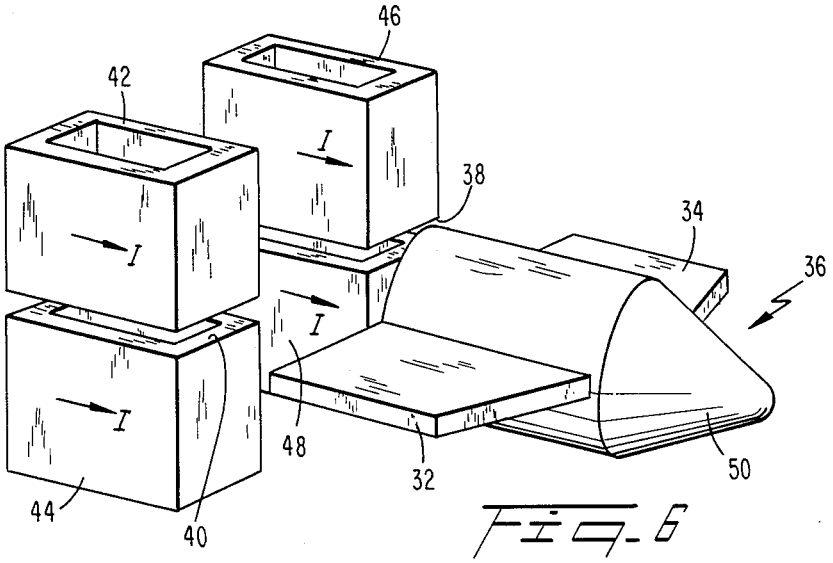
FIG. 6 shows an embodiment of the invention wherein the geometry of the overall projectile in not dictated by the geometry of the gap portion of the projectile and the gap between the coils.

The term "coaxial" herein is understood to refer both to either a straight axis in the case of a linear arrangement of opposing coils or a curved axis in the case of an arrangement of more than two opposing coils as in FIG. 6.

Preferably, the two coils of an opposed pair are connected in parallel with the power and switching means 24. Furthermore, the opposing coils are wound and connected together so that the magnetic flux that they generate are aligned in the same direction.

Figures 2A, 2B, 2C, 2D:
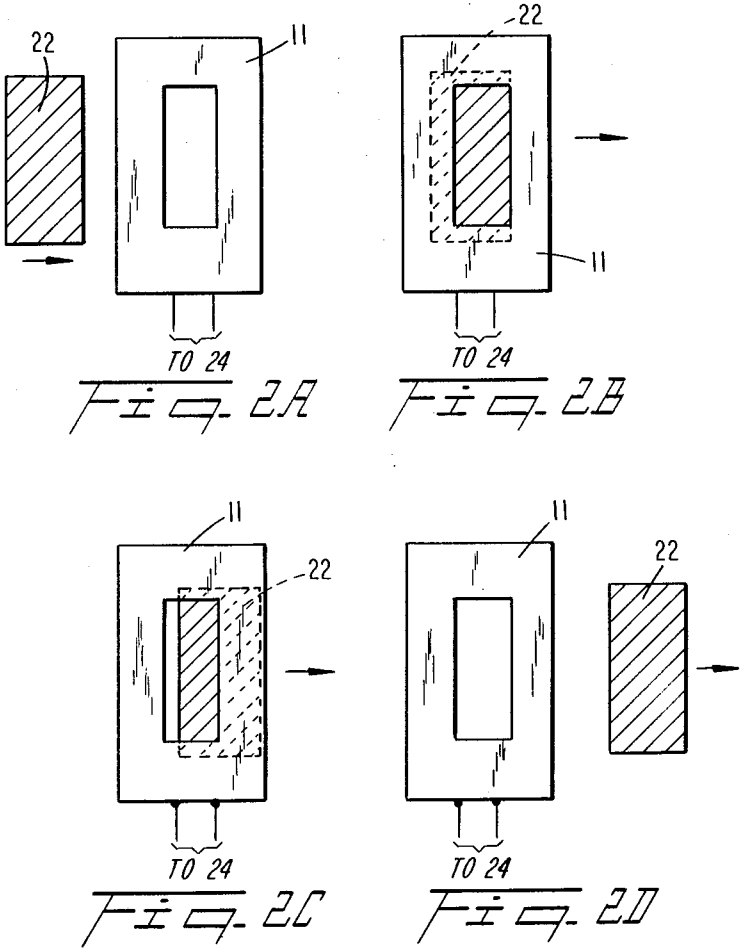
FIGS. 2A–2D are overhead views showing the sequence of locations of a gap portion of a projectile as it moves to and from an idealized pair of coils.

Referring to FIGS. 2A–2D, an idealized top coil of a coil pair, e.g. coil 11, is viewed from above. Projectile 22 is shown in FIG. 2A as it approaches but before it enters the gap between the coil pair. At this location, no current is applied to the coil pair from the power and switching apparatus 24. The projectile 22 can begin its flight through the launcher of the invention by an initiating force supplied by the magnetic forces generated in the launcher itself. Alternatively, movement of the projectile may be initiated by supplemental mechanical, magnetic, or electromagnetic means (not shown). The projectile 22 moves from left to right and reaches the second location which is depicted in FIG. 2B wherein the leading edge of the projectile 22 reaches the downstream side of the coil 11. At this location, the region for inductive coupling between the coils 11,12 and the projectile 22 is close to maximum, and current is applied to the coil pair 11,12 by apparatus 24.

As the current is applied to the coils, the projectile 22 continues to move in the direction of the arrow. Since the projectile 22 is longer than the bore of the coils, nearly maximum inductive coupling between projectile and coils is maintained as long as the adjacent ends of the opposing coils are completely blocked by the projectile 22. During the period of nearly maximum inductive coupling between the coil pair 11,12 and the projectile 22, the current reaches its peak value.

In FIG. 2C, the trailing edge of the projectile 22 has just cleared the upstream side of the coil bore. At this location, the magnetic flux lines of force between the coils 11 and 12 begin to join or reconnect behind the projectile 22. As the reconnecting magnetic lines of force straighten to relieve their tension, they propel the projectile 22 in the direction of the arrow.

In accordance with electrical circuit theory, as the projectile 22 clears the inner dimensions of the coils, the negative mutual inductance between the coils in the coil pair 11,12 and the projectile 22 is replaced by a positive mutual inductance between the two coils. This results in a large relative increase in effective inductance of the coils, and accounts for high efficiency and acceleration of the projectile in the launcher. In addition, with the electromagnetic launcher of the present invention, the inductance change during acceleration of the projectile does not require a large change in the volume of the magnetic flux. Therefore, the accelerating coils of the present invention can also serve as storage inductors.

FIG. 2D shows the projectile 22 projected out of the coil pair on its way to the next coil pair for further acceleration.

Figure 3D:
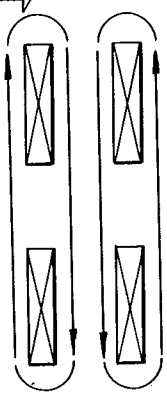
FIGS. 3A–3D are side views showing the sequence of magnetic flux reconnection as a gap portion of a projectile moves from an idealized pair of coils.
Figure 3C:
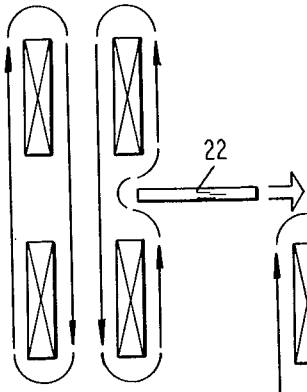
Figure 3B:
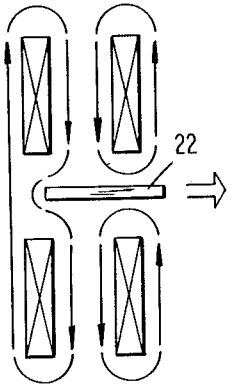
Figure 3A:
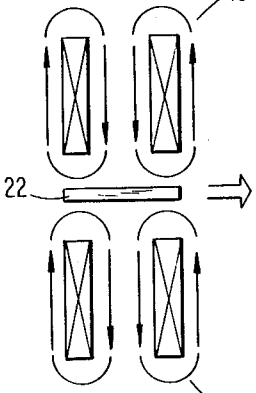

FIG. 3A shows top magnet coil 15 and bottom magnet coil 16 with the projectile 22 fully occupying the gap between the coils. The simplified magnetic flux lines show that the flux of the top coil 15 is separated or isolated from the flux lines of the bottom coil 16. That is, the magnetic flux lines of the top coil and the bottom coil are disconnected and do not cross the gap between the coils.

In FIG. 3B, the flux lines from the top and bottom coils begin to reconnect and cross the gap between the coils. At this time, a large portion of the electrical energy that went into the system when the top coil and bottom coil magnetic fluxes were isolated now begins to be transformed into the kinetic energy of the projectile as the magnetic flux reconnects. As the magnetic flux reconnects behind the projectile, a strong acceleration force is applied to the projectile at its trailing edge.

In FIG. 3C, the projectile 22 is almost completely outside the gap between the coils, and the reconnection of magnetic flux between the top and bottom coils is almost complete.

In FIG. 3D, the magnetic flux between the top and bottom coils is complete. At this point, the stored energy in the isolated magnetic fluxes has been substantially transformed into kinetic energy of the projectile, and the reconnected magnetic flux is at a substantially lower energy state than the isolated magnetic fluxes.

Figure 4:
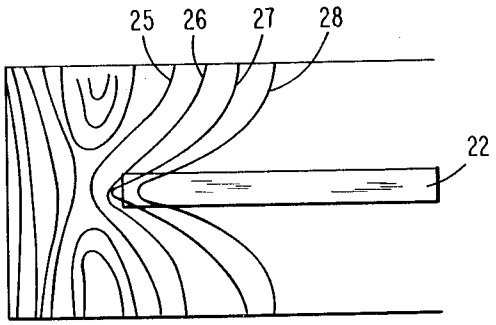
FIG. 4 shows a pattern of magnetic lines of force acting upon a gap portion of a projectile.

FIG. 4 shows a pattern of magnetic lines of flux that act upon a flat rectangular projectile 22 of the invention. It is seen that useful accelerating forces act upon the projectile at both the rear vertical surface of the projectile by flux lines 25 and 26 and at the horizontal surfaces of the projectile near the rear of the projectile by flux lines 27 and 28. An aluminum projectile was used for obtaining the flux pattern shown in FIG. 4.

Figure 5:
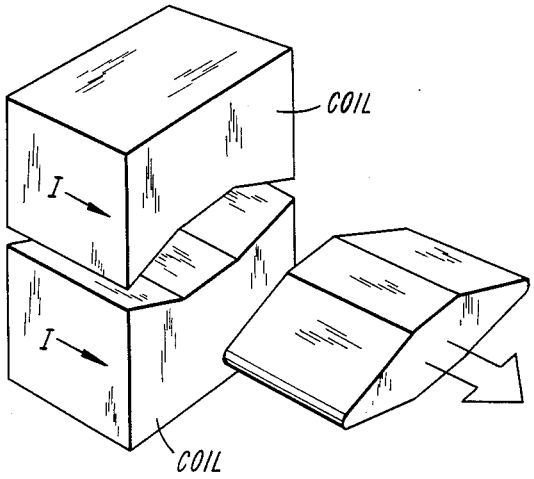
FIG. 5 shows a design of coils and a projectile having complementary geometrical shapes which enhance magnetic stablity in the projectile.

FIG. 5 shows a design of coils and projectile having complementary geometrical shapes which enhance magnetic stability in the projectile. The complementary shapes shown in FIG. 5 enhance magnetic restoring forces to maintain the flying projectile within the flyway.

In FIG. 6, an embodiment of the invention is shown wherein the geometry of the projectile is not dictated by the geometry of the gap between the coils. The entire projectile does not fit in the gap between the coils. Here, only gap portions 32,34 of the projectile 36 fit in the gaps 38 and 40 of two sets of coils 42,44 and 46,48; the remainder of the projectile 36 is a payload 50 attached to the gap portions 32, 34. The payload 50 can be a passive payload or can have its own propulsion source, such as a jet engine or rocket motor. Because plural sets of coils are used simultaneously, increased power can be supplied to the projectile. Although only one set of coil pairs is shown in FIG. 6 for propelling the projectile, it is understood that as many sets of coil pairs can be used in linear array as desired. A linear array of sets of coil pairs can be arranged in an array analogous to the linear array of coil pairs shown in FIG. 1.

Figure 7:
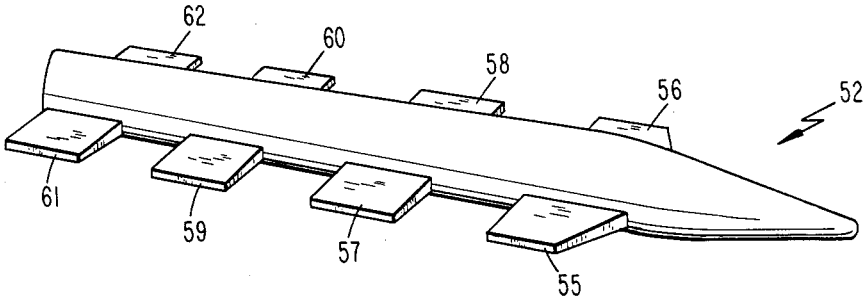
FIG. 7 shows a long thin projectile having a plurality of tandem gap portions.

In FIG. 7, a projectile 52 has a payload 54 and a plurality of pairs of gap portions 55,56; 57,58; 59,60; and 61,62. In this configuration, acceleration forces are distributed relatively evenly along the length of a long thin payload, such as an armor piecing projectile. Higher acceleration with relatively long payloads are possible with the plural sets of projectile gap portions than are possible with only a single set. To implement this embodiment of the invention, a plurality of coil stages are used and arrayed in a straight line. The power and timing of the electric power to the coils are controlled so that for a projectile having "n" sets of gap portions each opposing coil pair receives "n" pulses of electric power during a launch.

Figure 8:
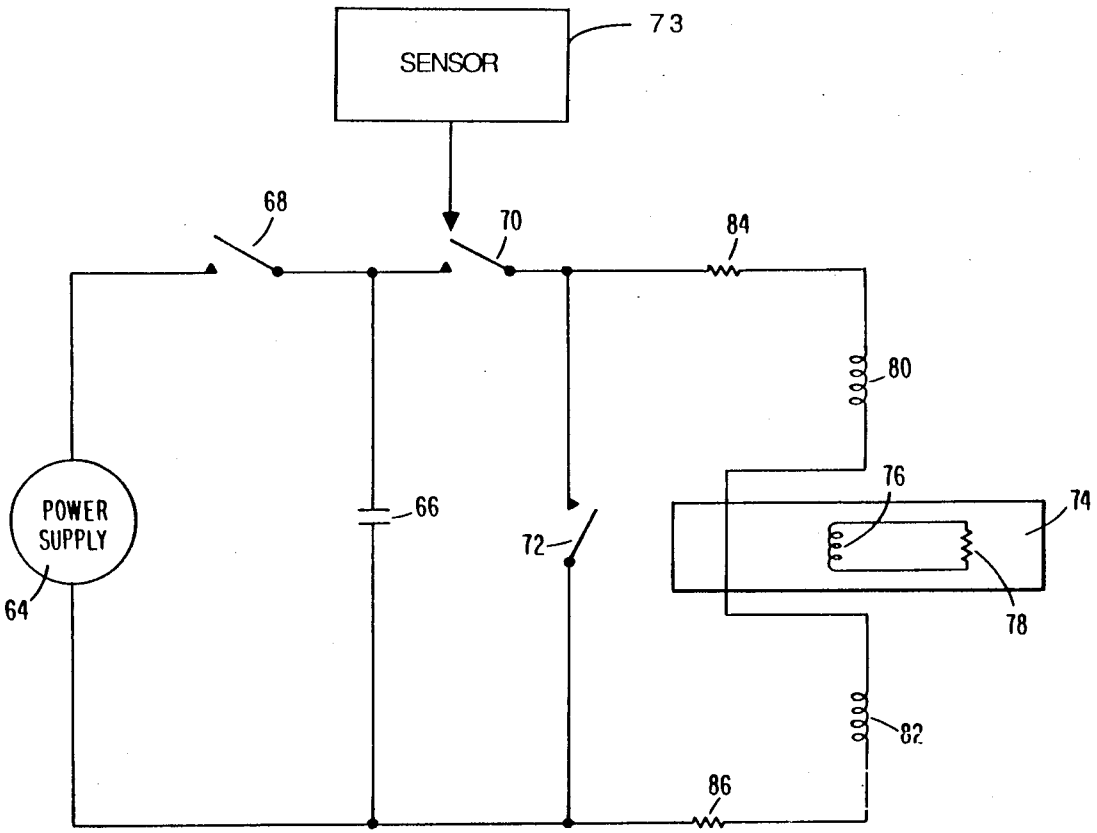
FIG. 8 is a schematic diagram of an electric circuit suitable for supplying electric power to the array of coils shown in FIG. 1.

FIG. 8 is a schematic diagram of circuitry for powering one stage of the electromagnet coils in FIG. 1. Each stage can be considered separately since each stage operates with the inductive energy stored in that stage. Inductances and resistances of transmission lines and switches are omitted.

The operating sequence of the circuit in FIG. 8 is as follows. Direct current power source 64 is used to charge capacitor 66 with switch 68 closed and switches 70 and 72 open. When the capacitor 66 is fully charged, switch 68 is opened. When the projectile 74, which is represented by the circuit including inductance 76 and resistance 78, reaches a position to achieve a value near the maximum for the mutual inductance between the coils 80 and 82 and the projectile 74, the switch 70 is closed. Closing of switch 70 causes very rapid building up of current in the coils 80 and 82. After current has been built up to a maximum in the coils 80 and 82, the "crowbar switch" 72 is closed thereby isolating the magnetic fluxes in the individual coils 80 and 82. In this way, the electrical energy that was earlier stored in capacitor 66 is stored as magnetic energy in the isolated coils 80 and 82. As the projectile 74 continues to move out from the gap between the coils 80 and 82, the magnetic isolation of the coils begins to decrease, and the magnetic flux begins to reconnect between coils 80 and 82. As the magnetic flux reconnects, the magnetic energy stored in the coils is converted into kinetic energy of the moving projectile 74. Appropriate resistances 84 and 86 are also present in the circuit.

The closing of the switch 70, which depends upon the optimum positioning of the projectile 74 in the gap between the coils 80 and 82, can be controlled by an optical sensing means or mechanical switches 73 which are actuated by the projectile 74.

More generally, the control of the switches for the application of electric energy to the coils and for the isolation of the magnetic flux in the coils can be brought about by sensors which sense the position and velocity of the projectile in conjunction with real time control apparatus such as a digital computer.

With use of the magnetic reconnection gun of the invention, when current is first applied to a coil pair, the gap portion of the projectile of the electromagnetic launcher is slightly heated as induced currents move within it when the projectile serves to isolate the two coils in the pair. However, as the projectile accelerates down the launcher, increased heating occurs at the rear of the gap portion of the projectile where the magnetic flux lines are exerting accelerating forces on the projectile. Depending on the material used and the velocity reached, the rear of the gap portion of the projectile may heat until some material is removed bhy melting or boiling before launch is complete. This boiling away of projectile material is referred to as "ohmic ablaton". The rear of the gap portion of the projectile includes a portion of ablative material located along the trailing edge of the gap portion. The ablative material minimizes the melting or boiling away of material due to ohmic heating; and the ablative material may be comprised of graphite or other carbon-based materials. The ohmic ablation reduces the length and mass of the gap portion of the projectile during launch, and the projectile is designed to compensate for these changes. A negligible increase in thrust on the projectile occurs from the ohmic ablation.

Numerous benefits have been described which result from employing the principles of the invention. Additional benefits are also obtained by employing the principles of the invention. With the invention a projectile mass can increase without a corresponding decrease in the acceleration of the projectile. To compensate for a projectile of increased mass, the width of the gap portion of the projectile and the width of the coils are increased. By increasing only the width, the accelerating force will increase in proportion to the increase in mass so that acceleration remains unchanged unchanged. In chemical guns, projectiles which are wider than they are long cannot be used because they are subject to the yaw instability, but this invention provides the necessary stabilizing forces to prevent yaw of a wide projectile. That is, the inductive gradient experienced by the projectile decreases in the direction of motion so that a trailing rear edge of the projectile experiences a greater acceleration than a leading rear edge.

With the invention, the accelerating forces that propel the projectile are applied to both the rear vertical surface of the gap portion of the projectile and to the horizontal surfaces of the gap portion of the projectile near the rear of the gap portion.

With the electromagnetic launcher of the invention, the height of the coils can be increased without changing the size of the projectile. The peak magnetic pressure used to accelerate the projectile is limited only by the strength that can be designed into the projectile.

With the launcher of the invention, average acceleration of the projectile down the flyway is relatively close to peak acceleration at all times. This is so because of relatively short stages and improved time constant over prior art devices. A relatively large gap can be maintained between opposing coils, and there can be a relatively large clearance between the coils and the gap portion of the projectile.

The gap portion of a projectile is moved through the flyway with great stability with respect to roll, pitch, and yaw of the projectile. The great stability is due to stabilizing forces exerted by the magnetic fields in the coils upon the gap portion of the projectile as it moves through the flyway. As described, the flyway is defined by the magnetic forces exerted by the electromagnetic coils in the gap between opposing coils. If the gap portion of a projectile during its passage down the flyway begins to deviate from a path down the center of the magnetically defined flyway, the magnetic forces defining the flyway automatically exert restoring forces on the projectile to restore the path of the gap portion of the projectile down the center of the flyway.

Because of the inherent stability of the magnetically defined flyway, there is no need for separate guide rails to guide the gap portion of the projectile.

Another way of providing stability to a gap portion of a projectile with respect to roll, pitch, and yaw as it moves down the flyway is to design the gap portion of the projectile so that it causes restoring froces to be exerted upon itself when it deviates from a central location in the flyway.

The foregoing description of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

In one variation, for example, the two coils of a stage in the magnetic reconnection launcher of the invention do not necessarily have to be connected in parallel. It is only important that magnetic flux which the coils carry be aligned in the same direction. The number of propelling stages that can be used can be any number as are necessary for the desired application.

In another variation, the opposing coils can be in shapes other than rectangular. For example, the coils can be cylindrically shaped. In another variation the opposing magnets can be arrayed with their axes on a closed loop so that both ends of each coil are opposed to form one gap per coil.

In yet another variation, the opposing magnets in the magnet pair can be superconducting magnets. A conductor, such as a mechanically operated metal piston, can be inserted relatively slowly, at a low power, in the gap between the magnets thereby disconnecting the magnetic flux between the magnets whereby the energy in the magnetic field will be increased and stored until such time when the mechanically operated conductor moves out of the gap, and the magnetic flux is reconnected, thereby projecting a projectile. In order to maintain the increased magnetic energy in a stage of the superconducting magnets, an additional winding on each magnet is provided with an inline switch which is closed thereby allowing the piston to be moved out of the gap without allowing magnetic reconnection for the stage. This state is maintained until the projectile fully occupies the gap in the stage. At that time, the inline switch for the additional magnet winding for the stage is opened thereby allowing the movement of the projectile to initiate magnetic reconnection behind it.

In another variation of the invention, the nonmaterial flyway can be evacuated to preclude the creation of sound wave shocks and aerodynamic heating as the projectile proceeds down the flyway.

Numerous electrically conductive materials can be used for fabricating the gap portion of the projectile. For example, the gap portion of the projectile can be made from material selected from the group consisting of aluminum and its alloys, titanium and its alloys, beryllium and its alloys, and carbon-containing fiber reinforced composites.

In another variation of the invention, the gap portion of the projectile can be jettisoned after the projectile is launched. The projectile can have its own fuel supply and own aerodynamic control can be a rocket, airplane, or the like.

In another variation of the invention, the power supply can include rotating generators such as homopolars or compulsators, rather than capacitors. However, for high velocities, the rotating generators may require an additional opening switch.

I claim:

1. An electromagnetic launcher comprising:

at least two coils for receiving electric current and storing magnetic energy, at least one end of each coil being in opposition to an end of another coil, said opposing ends being separated by a gap;

a projectile, at least of portion of said projectile defining an electrically conductive gap portion arranged for movement through the gap, said gap portion permitting substantially unrestricted distribution of eddy current densities therein, said projectile being moved by the magnetic energy store by said coils in a direction transverse to the axes of said coils; and electric power means for abruptly supplying electric power to said coils; and sensor means, responsive to the position of said projectile, for controlling said power means to prevent power from being supplied to said coils until said gap portion of said projectile substantially occupies the gap between said coils, and to supply power only when said gap portion of said projectile substantially occupies the gap between said coils;

wherein the reconnecting magnetic field lines across the gap push said projectile from the gap between said coils.

2. The electromagnetic launcher described in claim 1 wherein the magnetic polarities of said opposing coils are in the same direction.

3. The electromagnetic launcher described in claim 1 wherein the magnetic polarities of said opposing coils are of a complementary N-S-N-S or S-N-S-N magnetic polarity.

4. The electromagnetic launcher described in claim 1 wherein said coils are constructed of high strength beryllium copper and steel.

5. The electromagnetic launcher described in claim 1 wherein the magnetic energy generated by said coils causes accelerating forces to act upon said gap portion of said projectile at both a rear vertical surface of said gap portion of said projectile and at horizontal surfaces of said gap portion of said projectile near the rear of said gap portion.

6. The electromagnetic launcher described in claim 1 wherein said gap portion of said projectile is flat and rectangular in shape.

7. The electromagnetic launcher described in claim 1 wherein said gap portion of said projectile is longer than the length of said opposing coils.

8. The electromagnetic launcher described in claim 1 wherein said gap portion of said projectile fits within said gap between said opposing coils.

9. The electromagnetic launcher described in claim 1, further comprising guide means for guiding said gap portion of said projectile as it moves in said gap between said coils.

10. The electromagnetic launcher described in claim 1 wherein said guide means is comprised of two opposing parts each of which has a complementary fit with said gap portion of said projectile.

11. The electromagnetic launcher described in claim 1 wherein electric current is supplied to said opposing coils so that substantially an equal current circulates in the same direction in each coil.

12. The electromagnetic launcher described in claim 1 wherein an induced current circulates in said gap portion of said projectile in a direction opposite to the direction of current circulation in said coils.

13. The electromagnetic launcher described in claim 1 wherein said electric power means supplies current to said coils abruptly when said gap portion of said projectile fully occupies the gap between said opposing coils.

14. The electromagnetic launcher described in claim 1 wherein said electric power means supplies peak current to said opposing coils when fthere is substantially maximum inductive coupling between said gap portion of said projectile and said coils.

15. The electromagnetic launcher described in claim 1 wherein:

said electric power means prevents power from being supplied to said coils until said gap portion of said projectile is substantially coupled to said coils;

said electric power means supplies current to said coils quickly when said gap portion of said projectile is substantially coupled between said opposing coils;

said electric power means supplies peak current to said opposing coils when there is substantially maximum coupling between said gap portion of said projectile and said coils;

induced current circulates in said gap portion of said projectile permitting substantially unrestricted distribution of eddy current densities therein; and a substantial portion of the stored magnetic energy is converted to projectile kinetic energy by magnetic field reconnection between said opposing coils as the projectile exits the gap.

16. The electromagnetic launcher described in claim 1 wherein said projectile gap portion is made from materials selected from the group consisting of aluminum and its alloys, titanium and its alloys, beryllium and its alloys, and carbon-containing fiber reinforced composites.

17. The electromagnetic launcher described in claim 1 wherein said coils are rectangular.

18. The electromagnetic launcher described in claim 1 wherein said coils are coaxial.

19. The electromagnetic launcher described in claim 1 wherein said coils are arranged along straight axes to form one of said coil gaps for each pair of said coils.

20. The electromagnetic launcher described in claim 1 wherein said gap portion of said projectile further includes a portion of conductive ablative material located along the trailing edge of said gap portion of said projectile, said ablative material minimizing the melting or boiling away of material due to ohmic heating, and said ablative material including carbon.

* * * * *